US005584387A

United States Patent [19]

Grant

[11] Patent Number: 5,584,387

[45] Date of Patent: Dec. 17, 1996

[54] COMBINATION BOOK AND PACKAGE CASE ASSEMBLY

[76] Inventor: Richard B. Grant, 30 Lower College Rd., Kingston, R.I. 02881

[21] Appl. No.: 589,123

[22] Filed: Jan. 19, 1996

[51] Int. Cl.[6] ..... B65D 85/62; B42D 1/06

[52] U.S. Cl. ..... 206/216; 206/232; 206/470; 206/464; 206/579; 281/31; 281/27.2; 402/79

[58] Field of Search ..... 206/216, 232, 206/579, 231, 464, 465, 467, 469, 470, 471; 281/31, 29, 30, 27.2, 27.3, 37, 38; 402/79

[56] References Cited

U.S. PATENT DOCUMENTS

| | | | |
|---|---|---|---|
| 2,248,582 | 7/1941 | Phillips | 281/27.2 |
| 4,660,855 | 4/1987 | Pagliaccio | 402/79 |
| 4,739,883 | 4/1988 | Mohs et al. | 206/470 |
| 4,811,973 | 3/1989 | Kumar-Misir | 281/27.2 |
| 5,042,841 | 8/1991 | Friedman | 281/31 |
| 5,121,835 | 6/1992 | Grupe | 206/470 |
| 5,277,452 | 1/1994 | Skidmore | 281/31 |
| 5,293,993 | 3/1994 | Yates, Jr. et al. | 206/470 |
| 5,301,803 | 4/1994 | Hansen et al. | 206/232 |
| 5,303,825 | 4/1994 | Hansen et al. | 206/232 |
| 5,498,089 | 3/1996 | Motyka | 281/30 |

*Primary Examiner*—Jacob K. Ackun
*Assistant Examiner*—Luan K. Bui
*Attorney, Agent, or Firm*—Salter & Michaelson

[57] ABSTRACT

A combination book and package case assembly includes a book having front and back covers, pages disposed in between the front and back covers, and an external binding for joining the front and back covers and the pages together. The assembly further includes a hinge strip having a plurality of openings formed therein for attaching the hinge strip to the binding of the book, and a package case capable of receiving a premium related product therein for enhancing the marketability of the book. The package case has a base portion, a cover portion, and a hinge portion for hingedly connecting respective sides of the base and cover portions in such a manner that the cover portion is movable between a closed position in which it overlies the base portion and is in parallel relation thereto and an open position in which the cover portion is hingedly moved away from the base portion and is in angled relation thereto. The base and cover portions each have flanges on respective sides opposite the sides having the hinge portion, the flanges being formed with fastening elements for releasably attaching them to the hinge strip when the cover portion is moved to its closed position thereby releasably attaching the package case to the book.

9 Claims, 5 Drawing Sheets

COMBINATION BOOK AND PACKAGE CASE ASSEMBLY

BACKGROUND AND SUMMARY OF THE INVENTION

This invention relates generally to packaging, and more particularly to a combination book and package case assembly having a unique hinge which functions to releasably connect a package case containing a premium related product to a book for enhancing the marketability of the book.

The general concept of attaching associated articles to printed matter such as books, magazines, greeting cards, albums, etc., is well-known. One method is to attach the premium related product to the cover of the book with adhesive whereby the consumer peels off the premium related product from the book. Another example is disclosed in U.S. Pat. Nos. 5,301,803 and 5,303,825, both to Hansen et al., wherein packaged cassettes are attached to printed sheets. More specifically, the '803 patent discloses a package comprising an envelope for an index print sheet with its pictures visible through the envelope, and a holder for a cassette which contains the original negatives for the pictures shown in the envelope. The index sheet is visible through the transparent envelope and is used as a reference to more easily locate a particular frame disposed on the negatives contained inside the cassette. The envelope and holder are attached to one another in such a manner that when the package is closed, the sheet member is sandwiched between the cover and base of the package. The holder has a base portion with a pair of integral studs that project upwardly through openings formed in the envelope and are received in female receiving formations provided in a cover portion of the holder.

However, this patent and the other methods known heretofore lack any disclosure of being able to releasably attach a premium related product to a book without having to attach the product to the book cover (either front or back) in which the risk is run that the cover will be permanently defaced. Moreover, none of these known methods are capable of substantially preventing or permanently preventing the premium related product from being easily separated from the book thereby enhancing the likelihood of pilferage of the premium related product. There is presently a need for a book and package assembly which overcomes the deficiencies noted in the prior art.

Accordingly, among the several objects of the present invention are the provision of an improved combination book and package case assembly which enhances the marketability of the book being sold by including a premium related product attached to the book by a unique hinge construction; the provision of such an assembly which is capable of releasably attaching the premium related product to the book without defacing the book covers; the provision of such an assembly which is designed to make it nearly impossible to separate the premium related product from the book thereby reducing the likelihood of the premium related product from being stolen; the provision of such an assembly that is reusable, versatile, and has a neat, clean appearance; the provision of such an assembly which provides an unobtrusive storage space for storing the premium related product; and the provision of such an assembly which is cost-efficient to make, and easy to manufacture.

In general, the present invention is directed to a combination book and package case assembly comprising a book having front and back covers, pages disposed in between the front and back covers, and an external binding for joining the front and back covers and the pages together. The assembly further comprises a hinge strip having means for attaching the hinge strip to the binding of the book, and a package case capable of receiving a premium related product therein for enhancing the marketability of the book. The package case has a base portion, a cover portion, and a hinge portion for hingedly connecting respective sides of the base and cover portions in such a manner that the cover portion is movable between a closed position in which it overlies the base portion and is in parallel relation thereto, and an open position in which the cover portion is hingedly moved away from the base portion and is in angled relation thereto so as to provide access to the interior of the case. The base and cover portions each have flanges on respective sides opposite the sides having the hinge portion. Means is provided for releasably attaching the flanges of the base and cover portions to the hinge strip when the cover portion is moved to its closed position thereby releasably attaching the package case to the book.

More particularly, the attaching means of the present invention comprises four clearance openings formed in the hinge strip, four male fastening elements formed in the flange of the base portion, and four female fastening elements formed in the flange of the cover portion. The male fastening elements are aligned with and extend through the openings in the hinge strip, and are received in the female fastening elements for capturing the hinge strip therebetween to releasably attach the base and cover portions of the package case to the hinge strip.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
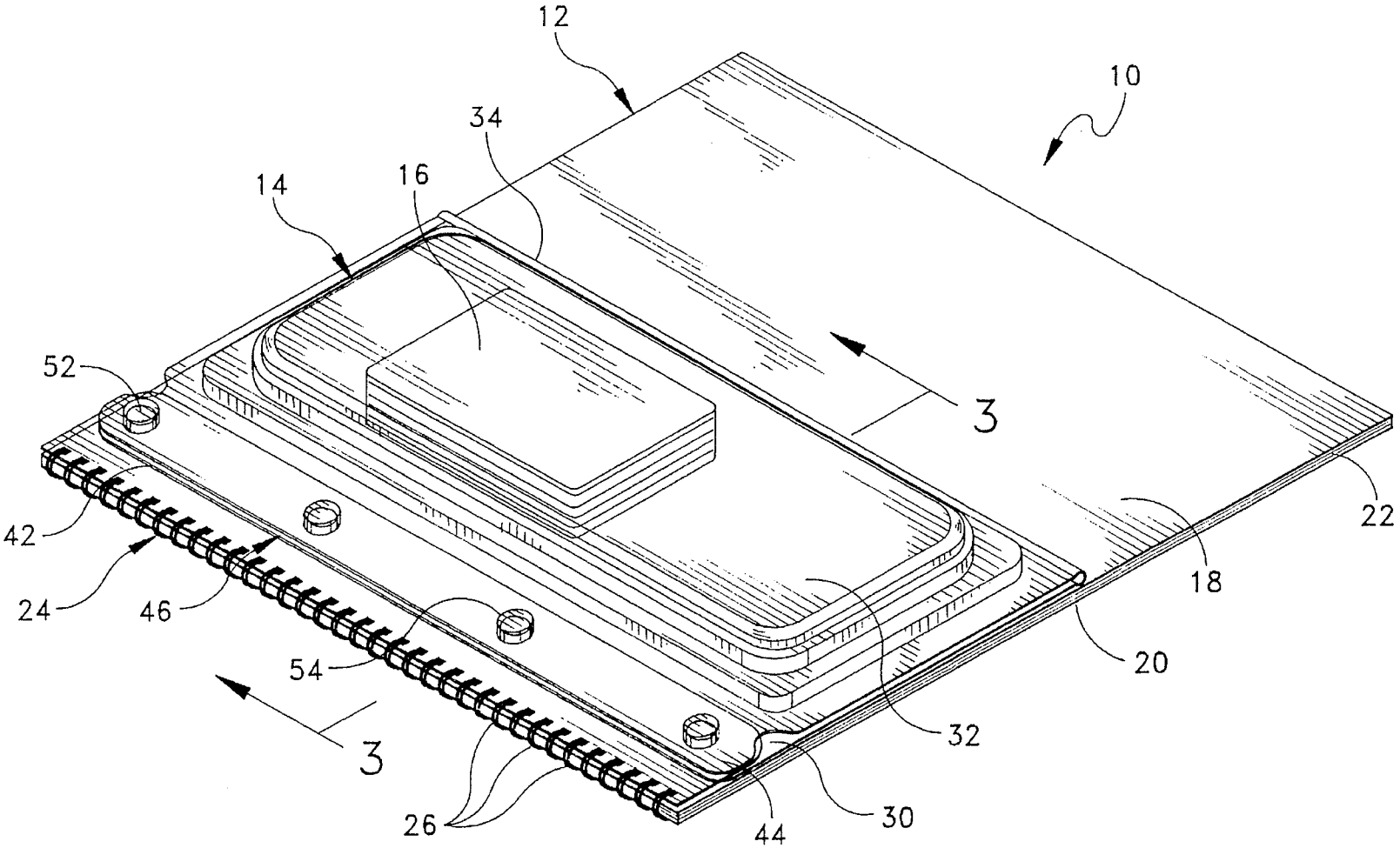
FIG. 1 is a perspective view of a combination book and package case assembly of the present invention.
Figure 2:
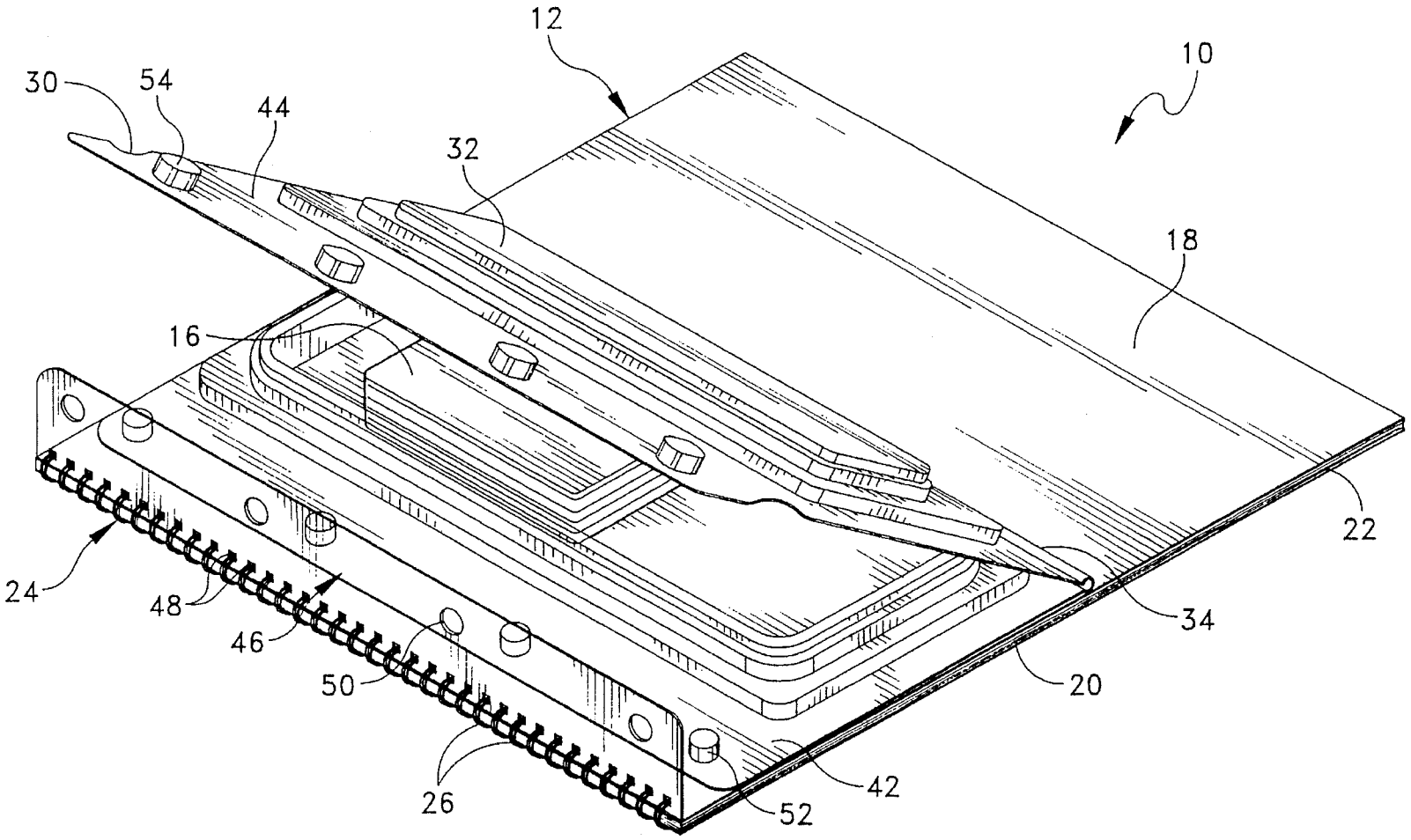
FIG. 2 is a perspective view similar to FIG. 1 illustrating a hinge strip of the assembly being disengaged from the package case.

Referring now to the drawings, and more particularly to FIGS. 1 and 2, there is generally indicated at 10 a combination book and package case assembly of the present invention. The assembly 10 comprises a book, generally indicated at 12, and a rectangular package case, generally indicated at 14, the package case 14 being capable of receiving therein a premium related product, such as a deck of cards 16, for enhancing the marketability of the book 12.

For example, in the shown embodiment, the book 12 can relate to card games and/or tricks that are played with the deck of cards 16 which accompanies the book 12 for enabling the purchaser of the book 12 to immediately begin practicing the games and/or tricks. It should be understood that for a particular book 12, any corresponding premium related product can be inserted in the package case 14 and still fall within the scope of the present invention.

The book 12 is of well-known construction, it having front and back covers 18, 20, multiple pages 22 disposed between the front and back covers, and an external binding generally indicated at 24 for Joining or binding the front and back covers 18, 20 and the pages 22 together. As illustrated throughout the drawings, the binding 24 is a conventional spiral-type binding, although other similarly constructed bindings can be used as well (e.g., three ring), and still fall within the scope of the present invention. As shown, the binding 24 comprises a plurality of binding members 26 which extend through corresponding openings 28 formed in the front and back covers 18, 20 and the pages 22 of the book 12. It should be noted that the members 26 are formed from an elongated spirally wound wire as is well known in the art.

The package case 14 includes a base portion 30, a cover portion 32, and a hinge portion 34 for hingedly connecting respective sides of the base and cover portions. Preferably, the package case 14 is fabricated from transparent vacuum-formed plastic wherein the hinge portion 34 is integrally formed with the base and cover portions 30, 32 as illustrated in FIG. 2, so as to provide a so called "living hinge". The cover portion 32 is movable between a closed position in which it overlies the base portion 30 and is in parallel relation thereto (see FIGS. 1 and 3), and an open position in which the cover portion 32 is hingedly moved away from the base portion 30 and is in angled relation thereto (see FIGS. 2 and 4), so as to provide access to the interior of the case.

Figure 3:
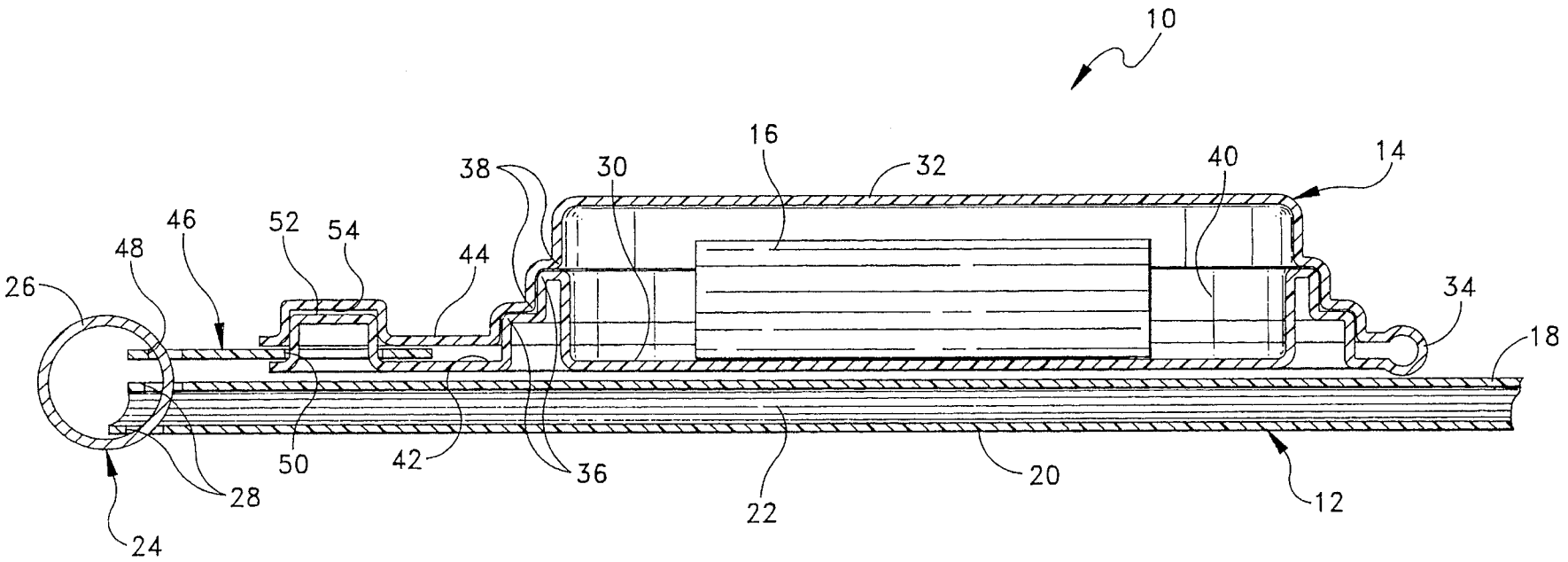
FIG. 3 is a cross-sectional view taken along line 3—3 in FIG. 1.
Figure 4:
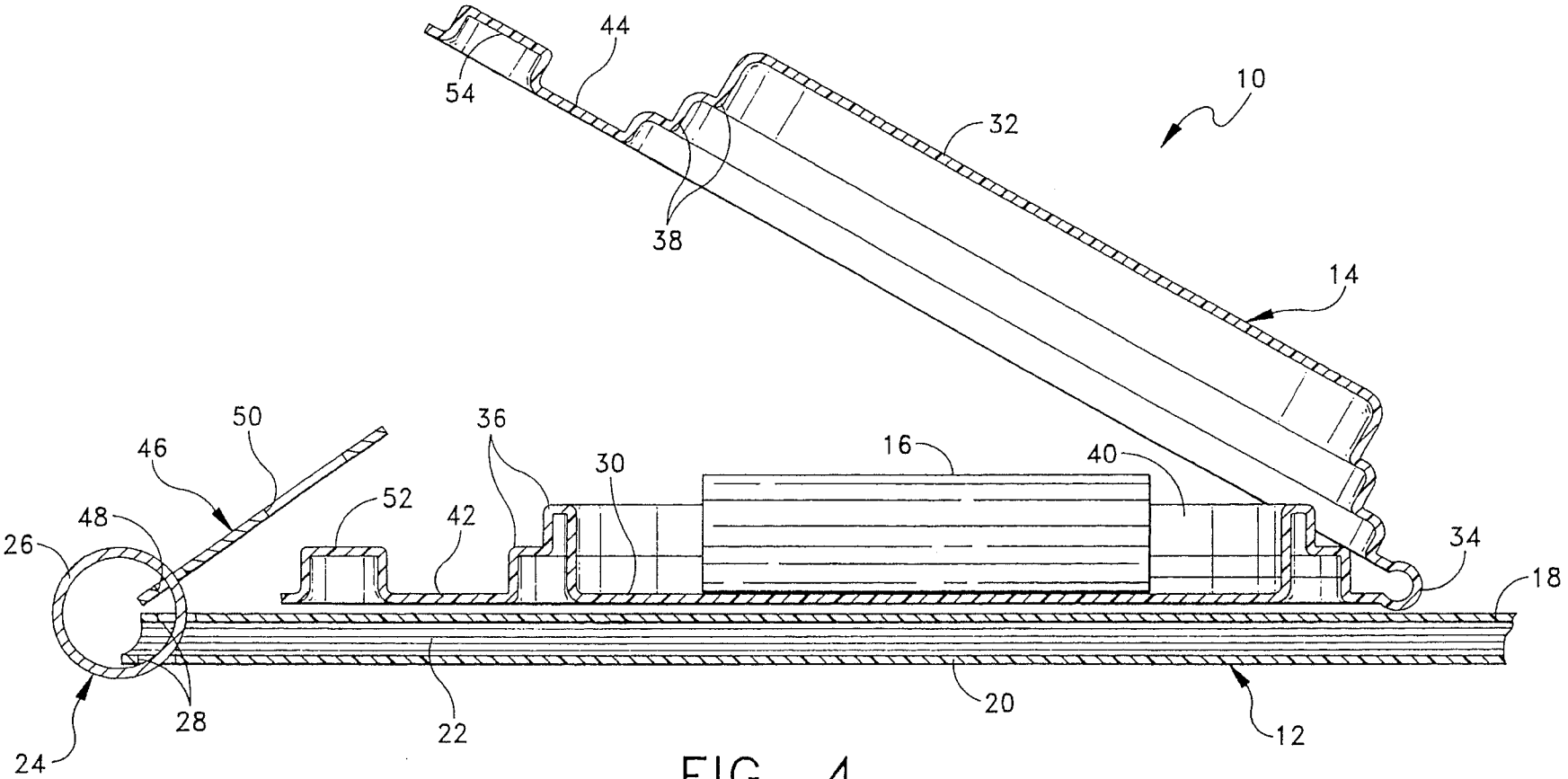
FIG. 4 is a cross-sectional view similar to FIG. 3 illustrating the hinge strip being disengaged from the package case with a cover portion of the package case in an open position.

Referring also to FIGS. 3 and 4, the package case 14 has interlocking means for maintaining the cover portion 32 in its closed position. More specifically, the package case 14 has a series of step formations (e.g., two) indicated at 36 formed in the base portion 30, and a series of mating step formations (e.g., two) indicated at 38 formed in the cover portion 32. The step formations 38 of the cover portion 32 snugly engage and snap-fit with the step formations 36 of the base portion 30 when the cover portion 32 is in its closed position so as to establish an interlocking relationship between the base and cover portions 30, 32 which is difficult to pry apart by hand, although not impossible to do so. These step formations 36, 38 of the base and cover portions 30, 32, respectively, create a hollow interior region 40 where the deck of cards 16 (or any other premium related item) is received.

The base portion 30 has an outwardly extending, flange 42 which is located along its side opposite the hinge portion 34. Similarly, the cover portion 32 has a mating flange 44 which is adapted to overly the flange 42 of the base portion 30 when the cover portion 32 is in its closed position. The significance of the flanges 42, 44 of the base and cover portions 30, 32, respectively, will be discussed in greater detail as the description of the assembly 10 proceeds.

The present invention is directed to means for releasably attaching the flanges 42, 44 of the base and cover portions 30, 32 of the package case 14 to a hinge strip, generally indicated at 46, which is attached by suitable means to the binding 24 of the book 12 when the cover portion 32 is moved to its closed position. As shown throughout the drawings, the hinge strip 46 has a plurality of openings 48 formed therein along its long edge margin which are aligned with and correspond to the binding members 26 of the binding 24 for securing the hinge strip 46 to the binding 24. This construction allows the hinge strip 46 to swingably rotate about the axis of the binding 24 as illustrate in FIG. 4. Preferably, the hinge strip 46 is fabricated from suitable plastic material, and is attached to the binding 24 in such a position that it overlies the front cover 18 of the book 12 in the manner illustrated in the drawings. The hinge strip 46 is provided with four circular clearance openings 50 which are aligned with one another along the length of the hinge strip.

The attaching means of the present invention further comprises four circularly-shaped male fastening elements 52 which are formed in the flange 42 of the base portion 30. These male fastening elements 52 correspond to and are aligned with the openings 50 of the hinge strip 46. The flange 44 of the cover portion 32 has four corresponding circularly-shaped female fastening elements 54 formed therein which are capable of receiving the male fastening elements 52 when the cover portion 32 is moved to its closed position. FIG. 3 illustrates the snap-fit relationship of one of the male fastening elements 52 of the flange 42 of the base portion 30 and one of the female fastening elements 54 of the flange 44 of the cover portion 32. The female fastening elements 54 are sized so that the male fastening elements 52 fit snugly therein. The arrangement is such that the male fastening elements 52 extend through the clearance openings 50 formed in the hinge strip 46, and are received in the female fastening elements 54 in the manner illustrated in FIGS. 1 and 3. In this position, the hinge strip 46 is captured or sandwiched between the flange 42 of the base portion 30 and the flange 44 of the cover portion 32 for securely attaching the package case 14 to the book 12.

Thus, in order to attach the package case 14 having a premium related product in its interior region (e.g., the deck of cards 16) to the hinge strip 46 (which in turn is attached to the book 12), the male fastening elements 52 of the base portions 30 of the package case 14 are inserted through the openings 50 of the hinge strip 46. The cover portion 32 is then moved to its closed position where the mating step formations 36, 38 of the base and cover portions 30, 32, respectively, are interlocked, and the female fastening elements 54 of the cover portion 32 receive the male fastening elements 52 of the base portion 30 therein in a snap-fit relationship. In this position the hinge strip 46 is held firmly in place between the flanges 42, 44 of the base and cover portions 30, 32. Although it certainly is not impossible to pry apart the cover portion 32 from the base portion 30, it is somewhat difficult to do so by virtue of the snap-fit relationships between the male and female fastening elements 52, 54 and the mating step formations 36, 38. This makes the combination book and package case assembly 10 of the present invention particularly effective in preventing the premium related product from being separated from the book and stolen.

However, by moving the cover portion 32 to its open position whereby the male fastening elements 52 are released from the female fastening elements 54 and the step formations 38 of the cover portion 32 are released from the step formations 36 of the base portion 30, the deck of cards 16 can be accessed by the consumer. Since this movement requires significant exertion on the part of the consumer, it cannot be accomplished easily without store personnel noticing the efforts made by the person attempting to surreptitiously separate the premium related product 16 from the book 12.

Figure 5:
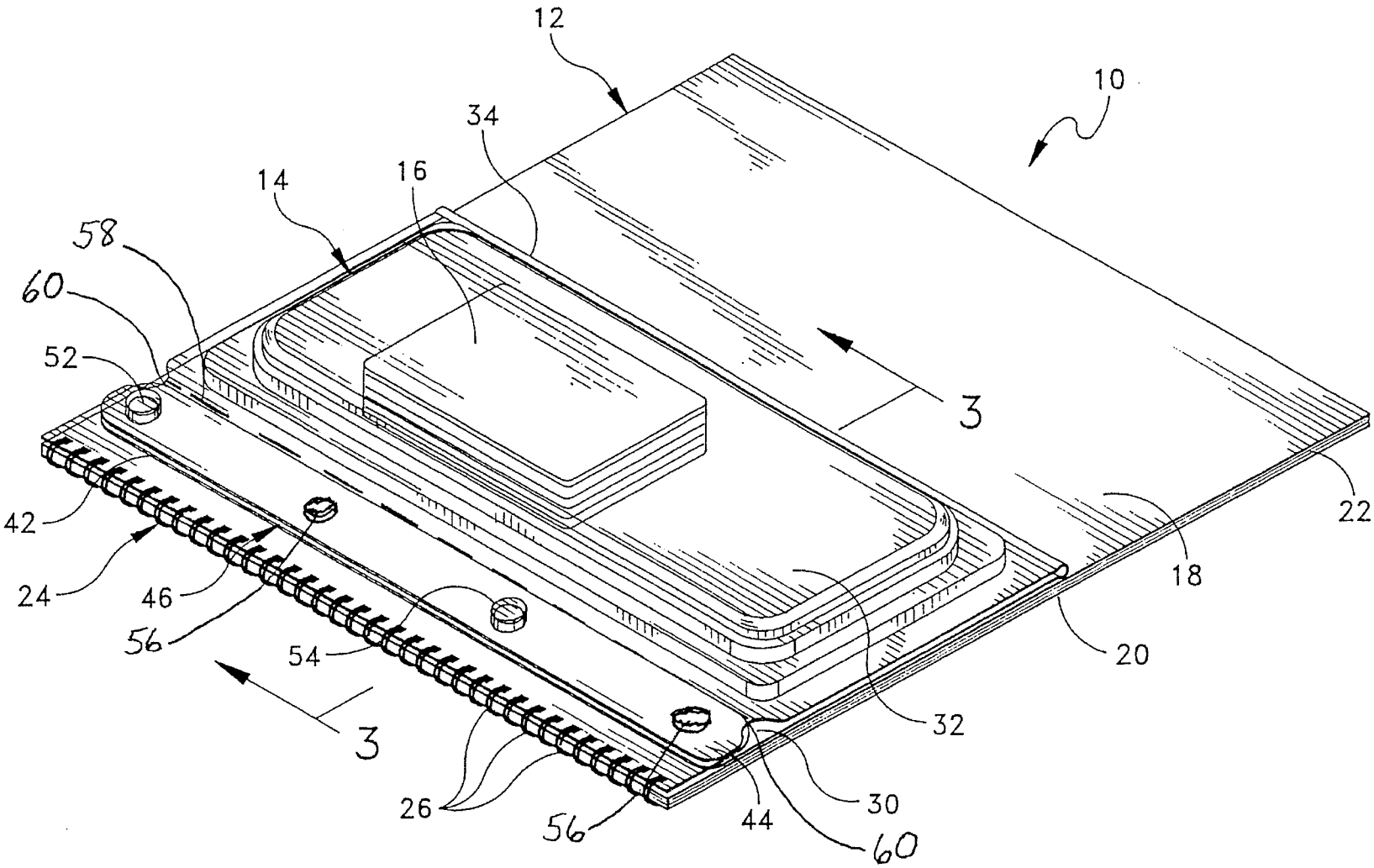
FIG. 5 is a perspective view similar to FIG. 1 illustrating the hinge strip being locked to the package case.

FIG. 5 illustrates a further use of the combination book and package case assembly 10 of the present invention. As shown, the hinge strip 46 is permanently attached to the package case 14 by crushing the male and female fastening elements 52, 54 so that they are permanently attached to one another. Reference number 56 represents two pairs of male and female fastening elements 52, 54 in such a crushed relationship. Thus is should be observed that since the base and cover portions 30, 32 permanently capture the hinge strip 46 therebetween, the package case 14 cannot be removed from the book 12. This reduces the likelihood of the package case 14 from being separated from the book 12.

A consumer can separate the package case 14 from the book 12 by cutting the base and cover portions 30, 32 along dashed line 58 which extends between semi-circular formations formed in the base and cover portions. The consumer can use a pair of scissors, or some other similar device, to cut along the dashed line 58.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A combination book and package case assembly comprising:

a book having front and back covers, pages disposed in between the front and back covers, and an external binding for joining the front and back covers and the pages together;

a hinge strip having means for attaching the hinge strip to the binding of the book;

a package case capable of receiving a premium related product therein for enhancing the marketability of the book, said package case having a base portion, a cover portion, a hinge portion for hingedly connecting respective sides of the base and cover portions in such a manner that the cover portion is movable between a closed position in which it overlies the base portion and is in parallel relation thereto and an open position in which the cover portion is hingedly moved away from the base portion and is in angled relation thereto, said base and cover portions each having flanges on respective sides opposite the sides having said hinge portion; and means for releasably attaching the flanges of the base and cover portions to the hinge strip when said cover portion is moved to its closed position thereby releasably attaching the package case to the book.

2. A combination book and package case assembly as set forth in claim 1, said attaching means comprising at least one opening formed in said hinge strip, a male fastening element formed in one of the flanges of the base and cover portions, and a female fastening element formed in the other flange of the base and cover portions, said male fastening element being aligned with and extending through the opening in the hinge strip and being received in the female fastening element for capturing the hinge strip therebetween to releasably attach the base and cover portions of the package case to the hinge strip.

3. A combination book and package case assembly as set forth in claim 2, said male fastening element being formed in the base portion of the package case and said female fastening element being formed in the cover portion thereof.

4. A combination book and package case assembly as set forth in claim 2, said hinge strip having at least two openings formed therein, and said base and cover portions having at least two male and female fastening elements, respectively.

5. A combination book and package case assembly as set forth in claim 2, said package case further having interlocking means for releasably maintaining said cover portion in its closed position.

6. A combination book and package case assembly as set forth in claim 5, said interlocking means comprising a series of step formations formed in the base portion, and a series of mating step formations formed in the cover portion, said step formations of the cover portion engaging and being interlocked with the step formations of the base portion when the cover portion is in its closed position.

7. A combination book and package case assembly as set forth in claim 1, said hinge portion of the package case being integrally formed with the base and cover portions.

8. A combination book and package case assembly as set forth in claim. 1, said binding having a plurality of binding members which extend through corresponding openings formed in the front and back covers and the pages of the book.

9. A combination book and package case assembly as set forth in claim 8, said means for attaching the hinge strip to the binding of the book comprising a plurality of openings formed in the hinge strip which are aligned with and receive the binding members of the binding.

* * * * *